US010674589B2

(12) United States Patent
Ostojic et al.

(10) Patent No.: US 10,674,589 B2
(45) Date of Patent: Jun. 2, 2020

(54) DERIVING A WHITE-POINT FOR USE IN A MULTI-COLOR LIGHT SCENE

(71) Applicant: PHILIPS LIGHTING HOLDING B.V., Eindhoven (NL)

(72) Inventors: Aleksander Ostojic, Eindhoven (NL); Bas Driesen, Nederland (NL); Berent Willem Meerbeek, Veldhoven (NL); Bartel Marinus Van De Sluis, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/061,073

(22) PCT Filed: Dec. 1, 2016

(86) PCT No.: PCT/EP2016/079441
§ 371 (c)(1),
(2) Date: Jun. 11, 2018

(87) PCT Pub. No.: WO2017/097660
PCT Pub. Date: Jun. 15, 2017

(65) Prior Publication Data

US 2018/0368236 A1 Dec. 20, 2018

(30) Foreign Application Priority Data

Dec. 10, 2015 (EP) ..... 15199434
Dec. 15, 2015 (EP) ..... 15200176
Jan. 5, 2016 (EP) ..... 16150140

(51) Int. Cl.
*H05B 47/00* (2020.01)
*H05B 47/175* (2020.01)
(Continued)

(52) U.S. Cl.
CPC ..... *H05B 47/175* (2020.01); *H05B 33/0857* (2013.01); *H05B 45/20* (2020.01); *H05B 47/155* (2020.01)

(58) Field of Classification Search
CPC ..... H05B 33/0863; H05B 33/0857; H05B 33/0869; H05B 37/0245; H05B 37/02;
(Continued)

(56) References Cited

U.S. PATENT DOCUMENTS 7,354,172 B2 * 4/2008 Chemel ..... H05B 33/0842 362/231
9,192,013 B1 * 11/2015 van de Ven ..... H05B 33/0857
(Continued)

FOREIGN PATENT DOCUMENTS

DE 102013106519 A1 12/2014
WO 2013140296 A1 9/2013

*Primary Examiner* — Tung X Le
*Assistant Examiner* — Borna Alaeddini
(74) *Attorney, Agent, or Firm* — Meenakshy Chakravorty

(57) ABSTRACT

When a light scene comprises multiple colors of light, not all white light is suitable for matching the scene. A method is provided such that a white point is determined for each color in a set of colors, to create a set of white points. A single white point is then determined based on the set of white points. This allows, for example, a user to select a light scene (e.g. a romantic scene featuring red colors) for a living room, such that lighting devices contributing to the scene emit colored light. A functional lighting device (e.g. reading light) can then emit white light, determined according to the method, to provide more functional light (e.g. light suitable for reading) that matches the scene (e.g. warm white instead of cold white).

20 Claims, 3 Drawing Sheets

(51) Int. Cl.
*H05B 33/08* (2020.01)
*H05B 45/20* (2020.01)
*H05B 47/155* (2020.01)

(58) Field of Classification Search
CPC ..... H05B 33/0821; H05B 33/0827; H05B 33/0845; H05B 33/086; H05B 33/0872; H05B 37/0254; H05B 37/0227; H05B 37/0272; H05B 37/029; H05B 39/088; H05B 33/0842; H05B 33/863; H05B 45/00; H05B 45/20; G09G 2340/06; G09G 5/02; G09G 5/10; G09G 2320/0271; G09G 2320/0666; G09G 3/2003; G09G 2320/0626; G09G 2320/066; G09G 2320/0673; G09G 2360/144; G09G 3/006; G09G 3/3413; G09G 5/06; G09G 2310/0235; G09G 2320/0233; G09G 2320/0276; G09G 2320/064; G09G 2320/106; G09G 2330/023; G09G 2330/045; G09G 2340/02; G09G 2340/14; G09G 2360/16; G09G 2370/04; G09G 3/2014; G09G 3/2018; G09G 3/2092; G09G 3/3208; G09G 3/3406; G09G 3/3426; G09G 3/3607; G09G 5/026
See application file for complete search history.

(56) References Cited

U.S. PATENT DOCUMENTS

| | | | | |
|---|---|---|---|---|
| 9,345,095 | B2 * | 5/2016 | Yan | H05B 33/0857 |
| 10,054,272 | B2 * | 8/2018 | Fieberg | H05B 33/0857 |
| 10,465,869 | B2 * | 11/2019 | Keller | F21V 23/003 |
| 2006/0104058 | A1 * | 5/2006 | Chemel | H05B 33/0842 362/231 |
| 2010/0277410 | A1 * | 11/2010 | You | G09G 3/3413 345/102 |
| 2011/0012512 | A1 * | 1/2011 | Young | F21K 9/00 315/117 |
| 2011/0305391 | A1 * | 12/2011 | Kunkel | H04N 1/6088 382/167 |
| 2012/0176063 | A1 | 7/2012 | Hatley et al. | |
| 2012/0280624 | A1 | 11/2012 | Baaijens et al. | |
| 2012/0286669 | A1 * | 11/2012 | Yan | H05B 33/086 315/151 |
| 2013/0271029 | A1 | 10/2013 | Liao et al. | |
| 2014/0232614 | A1 * | 8/2014 | Kunkel | H04N 9/67 345/1.1 |
| 2015/0342002 | A1 | 11/2015 | Jorgensen | |

* cited by examiner

DERIVING A WHITE-POINT FOR USE IN A MULTI-COLOR LIGHT SCENE

CROSS-REFERENCE TO PRIOR APPLICATIONS

This application is the U.S. National Phase application under 35 U.S.C. § 371 of International Application No. PCT/EP2016/079441, filed on Dec. 1, 2016, which claims the benefit of European Patent Application Numbers 15199434.0, filed on Dec. 10, 2015; 15200176.4, filed on Dec. 15, 2015; and 16150140.8, filed on Jan. 5, 2016. These applications are hereby incorporated by reference herein.

FIELD OF THE INVENTION

The invention generally relates to a method of controlling a lighting device, and more specifically to controlling a lighting to emit white light. The invention further relates to a computer program product for performing the method, a controller for controlling a lighting device and a lighting system.

BACKGROUND OF THE INVENTION

Modern lighting devices offer advanced control features, such as color control and dim level control. Output of the lighting device can be controlled through a user interface, for example, an application on a smart phone. This allows a user to select various colors of light to be emitted by various lighting devices. Not all colors of light are suitable for all purposes. For example, saturated red light can create an intimate atmosphere, yet is generally unsuitable to read by. There is a need for simplified and intuitive control options for controlling the color of light emitted by lighting devices in a lighting system.

SUMMARY OF THE INVENTION

The inventors have realized that when a user uses colored light in a light scene to generate an atmosphere, there remains a need for (functional) white light. Such white light can be useful when reading a book, when light is used to navigate an area, to illuminate people or food in a way that provides a natural appearance, etc. Further, in a lighting system certain lighting devices may not be able to emit light of all colors and may be limited to emitting various colors of white light. When in a light scene multiple colors of light are combined (e.g. various red and yellow colors), then certain colors of white light provide a visually pleasing effect while others do not.

In a first aspect, a method of controlling at least one lighting device is provided. The method comprises: receiving a set of colors (the set comprising multiple colors); determining a set of white points based on the set of colors (one or t least one white point for a plurality of colors from the set of colors); determining a single white point based on the set of white points, and controlling the lighting device (to emit white light) according to the determined single white point. The set of colors can be received based on user input (e.g. a user selecting the colors, selecting an image from which the colors are extracted) or can be automatically generated (e.g. random selection of colors from a spectrum). The set of white points comprises one white point for each of multiple of the colors in the set of colors (e.g. all colors in the set of colors) and a single white point is determined based on the set of white points. The lighting device is then controlled such that the at least one lighting device emits white light according to the determined single white point. The light emitted by the lighting device rendering white light is thus not a random color of white, but a color of white determined based on the set of colors. The colors in the set of colors can be rendered by further lighting devices or by the same lighting device (e.g. in a dynamic light effect).

A white point refers to a color of white light that is a mixture of multiple frequencies in the visible spectrum, i.e. a 'color' which humans will generally label as white. This is due to white light stimulating all three types of color sensitive cone cells in the eye, generally to relatively the same extent. Here white light is not necessarily fully achromatic, colors that are on or close to the black body line fall within the definition. The functional difference between white light and colored light, is that white light allows a person to see almost all colors of various objects. It comprises a sufficiently broad spectral mixture of light to match the large variety of colors objects may have (e.g. paper and printed text in a book a person is reading, wooden flooring and stucco walls in an environment a person is navigating).

The set of colors received will not necessarily comprise all colors as rendered by a lighting system, and/or a white point can be determined for inclusion in the set of white points only for certain or for all colors of the received set of colors. For example, a white point can be determined for a subset of colors, such that the lighting system will render all colors in a set of colors and determine a white point, to be rendered by one or more lighting devices, based on a subset of the set of colors. Such can be advantageous when certain lighting devices, which will emit colors from the subset of colors, are visually close to the lighting devices that are to emit the white light. The color of the white light is then determined based only on the colors of light emitted by the lighting devices nearby those lighting devices that will emit white light. Other lighting devices that are further away, do not influence the determination of the single white point in such an implementation. Another example of why a white point need not necessarily be determined for each color of the set of colors, is to save processing power. When the method is executed on a device with little computing power of memory, such as a smart phone, or when there are a large number of colors, a white point is determined only for certain colors. For example, half the colors can be (randomly) selected from the set of colors, or only a single color of colors in the same area in color space are selected.

In various embodiments of the method according to the first aspect, the set of colors is determined based on user input, and/or the set of colors is determined based on sensor input. The set of colors can, for example, be picked by a user in a user interface, the method then providing a matching white color. One or more optical sensors can be used to determine the color of light emitted by lighting devices, such that reading out the sensor output provides the set of colors. Further examples of receiving a set of colors are: receiving a set of colors from a machine interface (e.g. an application programming interface), randomly selecting a set of colors, extracting a set of colors from an image, etc.

In an embodiment of the method according to the first aspect, determining a white point for at least one color in the set of colors comprises: desaturating, in a predetermined color space, the at least one color along a first path according to a first function; and determining as a white point, for the at least one color, a color point along the first path at a predetermined distance from the black body line. This is advantageous as a white point can be easily determined by desaturating a color from the set of colors.

In various embodiments of the method according to the first aspect, determining a white point for at least one color in the set of colors comprises: desaturating, in a predetermined color space, the at least one color along a first path according to a first function; determining as an intermediate color point, for the at least one color, a color point along the first path at a predetermined distance from the black body line; desaturating, in the predetermined color space, the intermediate color point along a second path according to a second function; and determining as a white point, for the at least one color, a color point along the second path at a further predetermined distance from the black body line. The first function can be a transfer function avoiding a predetermined region of color space. The further predetermined distance from the black body line can be such that the white point chosen is on the black bodyline. The second function can be arranged such that the second path is perpendicular to the black body line.

In an especially advantageous embodiment of the method according to the first aspect, the predetermined color space is the U'V' color space.

In yet a further embodiment of the method according to the first aspect, determining a single white point based on the set of white points comprises: determining as a single white point, the average white point of the set of white points. Optionally, the method further comprises: determining an intensity level for each color of the set of colors, wherein the average of the set of white points is a weighted average based on the determined intensity level. The intensity level can relate to at least one of: the brightness level according to which light of each color of the set of colors is emitted, the number of lighting devices emitting each color of the set of colors, the contribution to a scene of each color of the set of colors, and the position of lighting devices emitting each color of the set of colors, such that the influence on the determination of the single white point is dependent on the perceived intensity of each color of the set of colors.

In another embodiment of the method according to the invention, the method further comprises: storing the determined single white point and/or the received set of colors in a memory.

In yet another embodiment of the method according to the first aspect, the set of colors are part of a dynamic light scene, and the color of light emitted by the lighting device changes over time, wherein the lighting device can emit colored light according to one or more colors from the set of colors and subsequently white light according to the single white point (or vice versa).

In a second aspect, a computer program product is provided for performing the method according to the first aspect. Such a computer program product can reside on a smart device (e.g. a mobile phone) as an application. As a further example, it can be made downloadable through an application store accessible to the smart device. The computer program product can run on a single device, such as a single mobile phone, or across multiple devices. For example, user input can be acquired through a user interface on a smart device, whereas image processing steps are performed on a server. As yet another example, control commands to control the one or more lighting devices to generate the dynamic light effect can be sent from the smart device or from a controller, such as a bridge device, arranged for controlling the one or more lighting devices.

In a third aspect a controller for controlling a lighting device is provided. The controller comprises: a first interface (an input), a second interface (an output) and a processor. The controller can comprise a memory (e.g. as part of the processor or as an additional component). The first interface (input) of the controller is arranged for receiving a set of colors. The input can be a hardware interface to e.g. a DALI or DMX bus on which control commands are sent from which color information is extracted. The input can be a software interface, such as an Application Programming Interface (API) that receives calls from software components, or an interface to an API of another software component. The input can be a user interface allowing a user to select colors by, for example, using a color picker, by selecting a light scene or by selecting an image from which colors are extracted. The output is arranged for controlling the lighting device. The second interface (output) can be a wired interface to a DALI or DMX bus, for example, the same as the first interface (i.e. the first and the second interface can be the same physical and/or logical entity). The output can be a wireless interface, such as ZigBee Light Link or WiFi interface.

The processor coupled to the first interface (input) and the second interface (output). The processor is arranged to perform the method according to the first aspect (e.g. by running the computer program product according to the second aspect). The processor is thus arranged to: determine a set of white points comprising a white point for each of a plurality of colors in the set of colors; determine a single white point based on the set of white points, and control the lighting device to emit white light according to the determined single white point.

In an embodiment of the controller according to the third aspect, the controller further comprises a third interface for controlling a further lighting device, and the processor is further arranged for controlling the further lighting device to emit colored light according a color of the received set of colors. The third interface can comprise the same interface as the second interface.

According to a fourth aspect, a lighting system is provided. The lighting system comprising the controller according to the third aspect and further comprising the lighting device. In an embodiment the lighting system comprises multiple lighting devices, for example when the controller comprises the third interface according to an embodiment of the controller according to the third aspect.

These and other aspects of the invention will be apparent from and elucidated with reference to the embodiments described hereinafter.

DETAILED DESCRIPTION OF EMBODIMENTS

Figure 1:
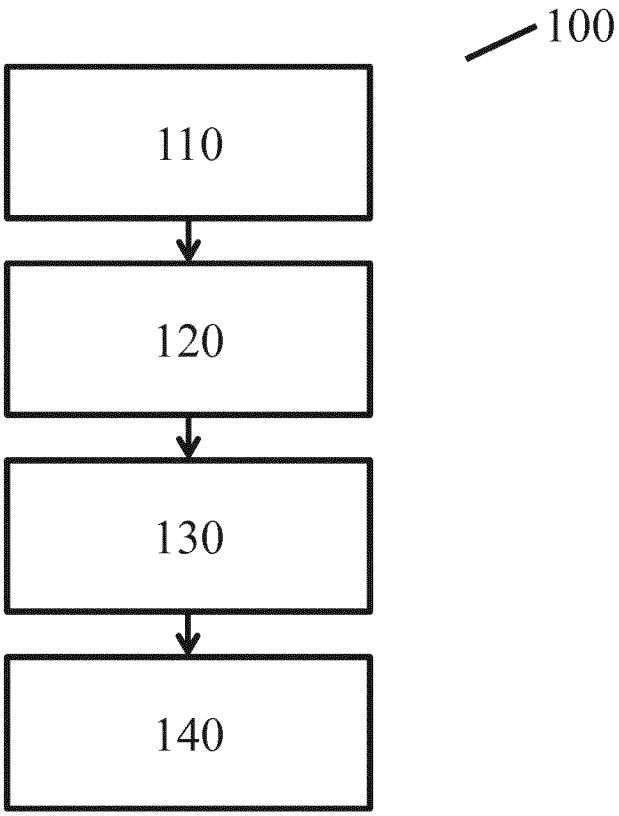
FIG. 1 shows schematically and exemplarily a method of controlling a lighting device.

In FIG. 1 a method 100 of controlling a lighting device is shown. The method 100 comprises: receiving a set of colors 110, determining a set of white points 120, determining a single white point 130, and controlling the lighting device 140. A user may select a set of colors, for example, through a user interface allowing the user to select an image from which colors are automatically extracted. This set of colors is then received as part of the method. For each color (or at least multiple colors) in this set of colors, a white point is determined. For a saturated red color, a reddish-white white point can be determined and for a yellow color, a yellowish-white point can be determined. As a single white point, a warm white can then be determined instead of a cold white, as the warm white will better fit a scene comprising the saturated red and the yellow color of the set of colors.

In a larger lighting system, or a lighting system spanning a large area, the method can be applied to individual groups of lighting devices such that multiple white points are determined. As an example, when a dining room and kitchen are situated in the same open space, then warm colors (e.g. red) creating an atmosphere in the living room can be complemented with white point that is warm, and cold colors (e.g. blue) creating a different atmosphere in the kitchen can be complemented with a white point that is cold.

Figure 2:
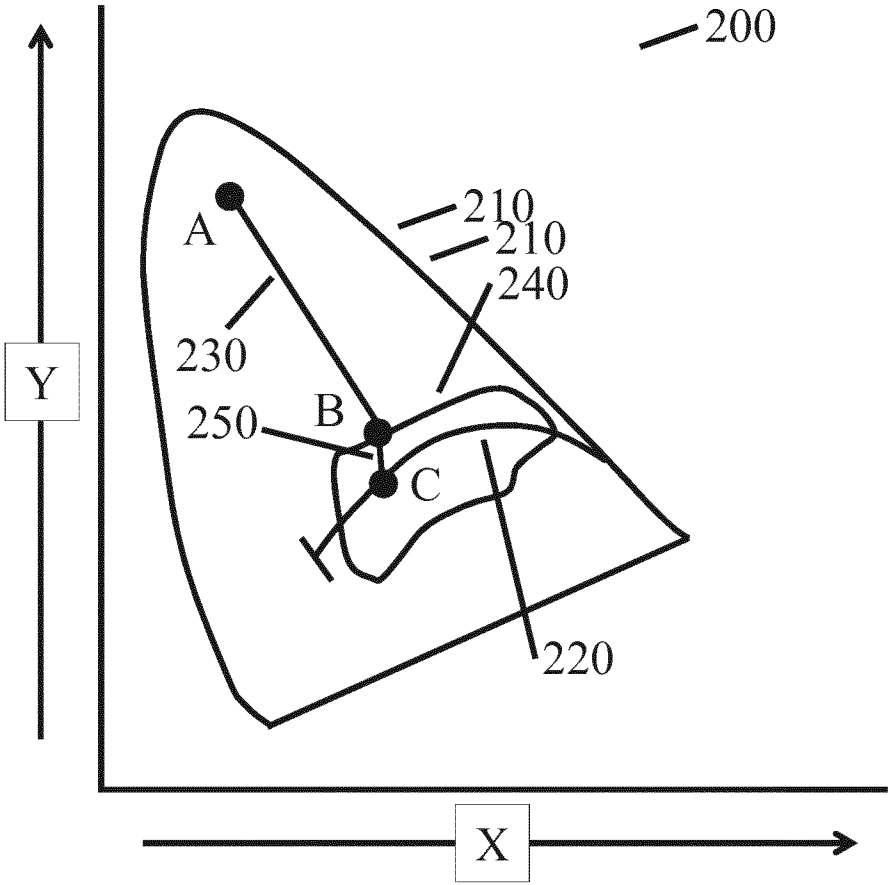
FIG. 2 shows schematically and exemplarily a color space diagram illustrating the method.

In FIG. 2*a* CIE 1931 XY chromatic color diagram 200 is shown. Within a color space 210 lies the black body line 220. From a first color point A using a first function a path 230 leads to color point B which is a predetermined distance 240 from the black body line 220. From the second color point B a second function provides a path 260 to color point C which is on the black body line 220.

The first function can, as an example, comprise a correlated color temperature calculation. This is beneficial when the first color point lies close to the black body line. Such a calculation in a U' V' color space creates a path perpendicular to the black body line. As a further example, a different function can be used to accommodate a first color point far from the black body line. Such a different function can comprise defining areas in the color space that are associated with specific point on the black body line. Continuing these examples, in an implementation of the method the correlated color temperature calculation is used when the first color point is less than a predetermined value away from the black body line (e.g. less than 0.001 units in the color space in which the calculation is performed) and the further function is used when the first color point is more than said predetermined value away from the black body line. As another example, an intermediate blending function can be used such that a first color point further away from the black body line (e.g. more than 0.01 units) is leads to a predetermined point being selected on the black body line based on the area of the color space the first color point is in; and a white point for a first color point that is at a medium distance from the black body line (in this example, more than 0.001 and less than 0.01 units) is determined using both functions, the outcome of which is averaged. For such a first color point at a medium distance from the black body line, a first white point is then calculated based on a correlated color temperature calculation and a second white point is then determined based on the area in the color space that the first color point is in, to which a white point on the black body line is associated. This first and second white point are then averaged, such that one white point is added to the set of white points for this first color point.

Figure 3:
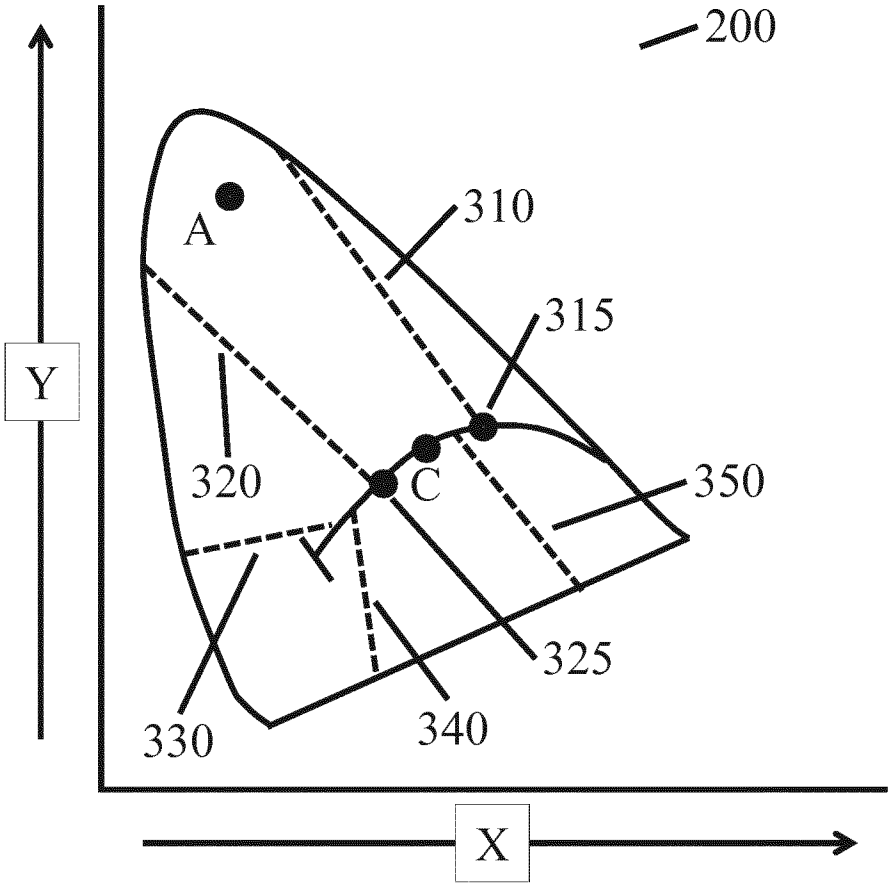
FIG. 3 shows schematically and exemplarily determining a white point for a first color point according to an embodiment of the method.

As yet another example, multiple predetermined paths, in a color space, leading to the black body line can be predetermined. For each first color point the nearest path can then be used to determine an appropriate white point to add to the set of white points. In a more advanced implementation, shown in FIG. 3, two such paths 310, 320 are selected from multiple such predetermined paths 310, 320, 330, 340, 350. The selection is based on which paths the first color point A lies in between. The two white points 315, 325 associated with these two paths 310, 320 are then averaged to determine a white point C to add to the set of white points.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A method of controlling a first lighting device, the method comprising:

receiving a set of colors, selected by a user and rendered by further lighting devices, determining a set of white points comprising a white point for each of a plurality of colors in the set of colors previously selected by the user, the selection comprising selecting the set of colors via selecting an image from which the plurality of colors are extracted, determining a single white point based on the set of white points, and controlling the first lighting device to emit white light according to the determined single white point.

2. The method according to claim 1, wherein determining a white point for at least one color in the set of colors comprises:

desaturating, in a predetermined color space comprising a black body line, the at least one color along a first path according to a first function; and determining as a white point, for the at least one color, a color point along the first path at a predetermined distance from the black body line.

3. The method according to claim 2, wherein the first function is a transfer function avoiding a predetermined region of color space.

4. The method according to claim 1, wherein determining a white point for at least one color in the set of colors comprises:

desaturating, in a predetermined color space comprising a black body line, the at least one color along a first path according to a first function, determining as an intermediate color point, for the at least one color, a color point along the first path at a predetermined distance from the black body line, desaturating, in the predetermined color space, the intermediate color point along a second path according to a second function, and determining as a white point, for the at least one color, a color point along the second path at a further predetermined distance from the black body line.

5. The method according to claim 4, wherein the second function is arranged such that the second path is perpendicular to the black body line.

6. The method according to claim 1, wherein the predetermined color space is the U'V' color space.

7. The method according to claim 1, wherein determining a single white point based on the set of white points comprises:

determining as a single white point, the average white point of the set of white points.

8. The method according to claim 7, the method further comprising:

determining an intensity level for each color of the set of colors, wherein the average of the set of white points is a weighted average based on the determined intensity level.

9. The method according to claim 1, the method further comprising:

storing the determined single white point and/or the received set of colors in a memory.

10. The method according to claim 1, the method further comprising:

controlling the further lighting devices to emit colored light according to the received set of colors.

11. A non-transitory computer-readable medium comprising a computer program product arranged for performing the method according to claim 1 when run on one or more processors.

12. The method according to claim 1, wherein said set of colors are colors of light present in an environment, and wherein the image is an image of the environment.

13. The method according to claim 12, wherein the controlling the first lighting device to emit the white light comprises controlling the first lighting device to emit said white light in said environment.

14. A controller for controlling a first lighting device, the controller comprising:

a first interface arranged for receiving a set of colors, selected by a user and rendered by further lighting devices, a second interface arranged for controlling the first lighting device, and a processor coupled to the first and second interface, wherein the processor is arranged for:

determining a set of white points comprising a white point for each of a plurality of colors in the set of colors previously selected by the user, the selection comprising selecting the set of colors via selecting an image from which the plurality of colors are extracted, determining a single white point based on the set of white points, and controlling the first lighting device to emit white light according to the determined single white point.

15. The controller according to claim 14, comprising a third interface for controlling the further lighting devices, and wherein the processor is further arranged for controlling the further lighting devices to emit colored light according to the received set of colors.

16. A lighting system comprising the controller according to claim 15, the lighting system further comprising the first lighting device.

17. The controller according to claim 14, wherein said set of colors are colors of light present in an environment, and wherein the image is an image of the environment.

18. The controller according to claim 17, wherein the controlling the first lighting device to emit the white light comprises controlling the first lighting device to emit said white light in said environment.

19. A method of controlling a first lighting device, the method comprising:

receiving a set of color coordinate points, selected by a user and rendered by further lighting devices;

determining a set of white points comprising a respective white point for each corresponding color coordinate point of a plurality of color coordinate points in the set of color coordinate points previously selected by the user, wherein each respective white point, of said set of white points, is calculated by applying a function to the corresponding color coordinate point such that the calculated respective white point is independent of each other user-selected color coordinate point and such that the function approaches a black body line from said corresponding color coordinate point;

determining a single white point based on the set of white points; and controlling the first lighting device to emit white light according to the determined single white point.

20. The method of claim 19, wherein said single white point is different from each white point of said set of white points.

* * * * *